US008967716B2

(12) United States Patent
Mountz

(10) Patent No.: US 8,967,716 B2
(45) Date of Patent: Mar. 3, 2015

(54) INFANT CARE APPARATUS

(71) Applicant: Jonathan K. Mountz, Geigertown, PA (US)

(72) Inventor: Jonathan K. Mountz, Geigertown, PA (US)

(73) Assignee: Wonderland Nurserygoods Company Limited, Kwai Chung, N.T. (HK)

( * ) Notice: Subject to any disclaimer, the term of this patent is extended or adjusted under 35 U.S.C. 154(b) by 151 days.

(21) Appl. No.: 13/783,415

(22) Filed: Mar. 4, 2013

(65) Prior Publication Data

US 2013/0229040 A1 Sep. 5, 2013

Related U.S. Application Data

(60) Provisional application No. 61/634,713, filed on Mar. 5, 2012.

(51) Int. Cl.

| | |
|---|---|
| ***A47C 3/18*** | (2006.01) |
| ***A47D 13/10*** | (2006.01) |
| ***A47C 9/02*** | (2006.01) |

(52) U.S. Cl.

CPC .. *A47D 13/10* (2013.01); *A47C 9/02* (2013.01)

USPC ..... 297/256.12; 297/256.16; 297/259.1; 297/261.3

(58) Field of Classification Search

USPC ..... 297/256.12, 256.16, 260.1, 260.2, 297/259.1, 261.1, 261.2, 261.3, 258.1, 297/272.3

See application file for complete search history.

(56) References Cited

U.S. PATENT DOCUMENTS

| | | | | |
|---|---|---|---|---|
| 2,920,685 | A | 1/1960 | Trebilcock | |
| 3,659,895 | A * | 5/1972 | Dresden | 296/65.05 |
| 4,028,753 | A | 6/1977 | Rios | |
| 4,598,946 | A * | 7/1986 | Cone | 297/258.1 |
| 4,974,904 | A * | 12/1990 | Phillips et al. | 297/258.1 |
| 5,048,893 | A * | 9/1991 | Cowan et al. | 297/329 |
| 5,590,930 | A * | 1/1997 | Glockl | 297/313 |
| 6,938,954 | B1 * | 9/2005 | Hendren et al. | 297/256.12 |
| 7,073,859 | B1 * | 7/2006 | Wilson | 297/256.1 |
| 7,669,927 | B1 * | 3/2010 | Zaid | 297/260.2 |
| 7,918,505 | B2 * | 4/2011 | Raphael et al. | 297/260.2 |
| 7,938,489 | B2 * | 5/2011 | Nazari | 297/314 |
| 8,459,739 | B2 * | 6/2013 | Tamanouchi et al. | 297/256.16 |
| 8,511,749 | B2 * | 8/2013 | Hei et al. | 297/256.16 |
| 8,544,809 | B1 * | 10/2013 | Laurita | 248/346.06 |
| 8,702,169 | B2 * | 4/2014 | Abadilla et al. | 297/256.12 |
| 2002/0113469 | A1 * | 8/2002 | Stern et al. | 297/256.16 |
| 2007/0120404 | A1 * | 5/2007 | Bellows et al. | 297/256.16 |

(Continued)

FOREIGN PATENT DOCUMENTS

JP H07275073 A 10/1995

*Primary Examiner* — David R Dunn
*Assistant Examiner* — Timothy J Brindley
(74) *Attorney, Agent, or Firm* — Winston Hsu; Scott Margo

(57) ABSTRACT

An infant care apparatus capable of providing various swing motions is disclosed. The infant care apparatus includes a base, a sliding mount, and a seat frame. The base has a concave surface. The sliding mount has a convex surface matching with the concave surface and disposed opposite to the concave surface. The sliding mount slides above the concave surface by the convex surface. The seat frame is fixed on the sliding mount to be moved together with the sliding mount. Thereby, the seat frame together with the sliding mount can swing relative to the base in two dimensions. The infant care apparatus can provide various swing motions without any pendulum arm to child sitting thereon. Besides, the infant care apparatus can be assembled in a compact size facilitating transport.

17 Claims, 9 Drawing Sheets

(56) References Cited

U.S. PATENT DOCUMENTS

2010/0052387 A1* 3/2010 Hopke et al. ..... 297/260.2
2011/0049952 A1* 3/2011 Xiao ..... 297/256.16
2011/0074196 A1* 3/2011 Chen et al. ..... 297/260.2
2014/0084650 A1* 3/2014 Rabeony ..... 297/256.12

* cited by examiner

INFANT CARE APPARATUS

CROSS REFERENCE TO RELATED APPLICATIONS

This application claims the benefit of U.S. Provisional Application No. 61/634,713, which was filed on Mar. 5, 2012, and is incorporated herein by reference.

BACKGROUND OF THE INVENTION

1. Field of the Invention

The invention relates to an infant care apparatus, and especially relates to an infant care apparatus providing swing motions by relative sliding between two matching curved surface.

2. Description of the Prior Art

Bouncer seats, swings, car rides, plush toys and music have all been employed at one time or another by parents to aid in soothing their child. Bouncer seats are helpful, yet their repetitive motion can at times be boring or insufficient to calm a child. Moreover, a parent's time physically bouncing the unit could be otherwise used attending to another need in the baby's proximity. Swings are naturally smoothing, but tend to be large and not very portable. Furthermore, there is not much variety in a swing apart from the front to back pendulum motion. Plush toys can come to the rescue at times, but like choosing music, no parent knows what exactly will excite or calm their child. Lastly, car rides just are not always convenient or economical.

SUMMARY OF THE INVENTION

An objective of the invention is to provide an infant care apparatus capable of providing various swing motions by relative sliding between two matching curved surface.

The infant care apparatus includes a base, a sliding mount, and a seat frame. The base has a concave surface. The sliding mount has a convex surface matching with the concave surface and disposed opposite to the concave surface. The sliding mount slides above the concave surface by the convex surface. The seat frame is fixed on the sliding mount to be moved together with the sliding mount. In an embodiment, the concave surface is axially symmetrical relative to its central axis, like a bowl shaped surface; the concave surface is also axially symmetrical relative to its central axis, like a saucer shaped surface. Thereby, the two matching curved surface, i.e. the concave surface and the convex surface can slide relatively in two dimensions; that is, the seat frame together with the sliding mount can swing relative to the base in two dimensions. Therefore, compared with the prior art, the infant care apparatus according to the invention can provide various swing motions without any pendulum arm to child sitting thereon. Besides, the infant care apparatus can be assembled in a compact size facilitating transport.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
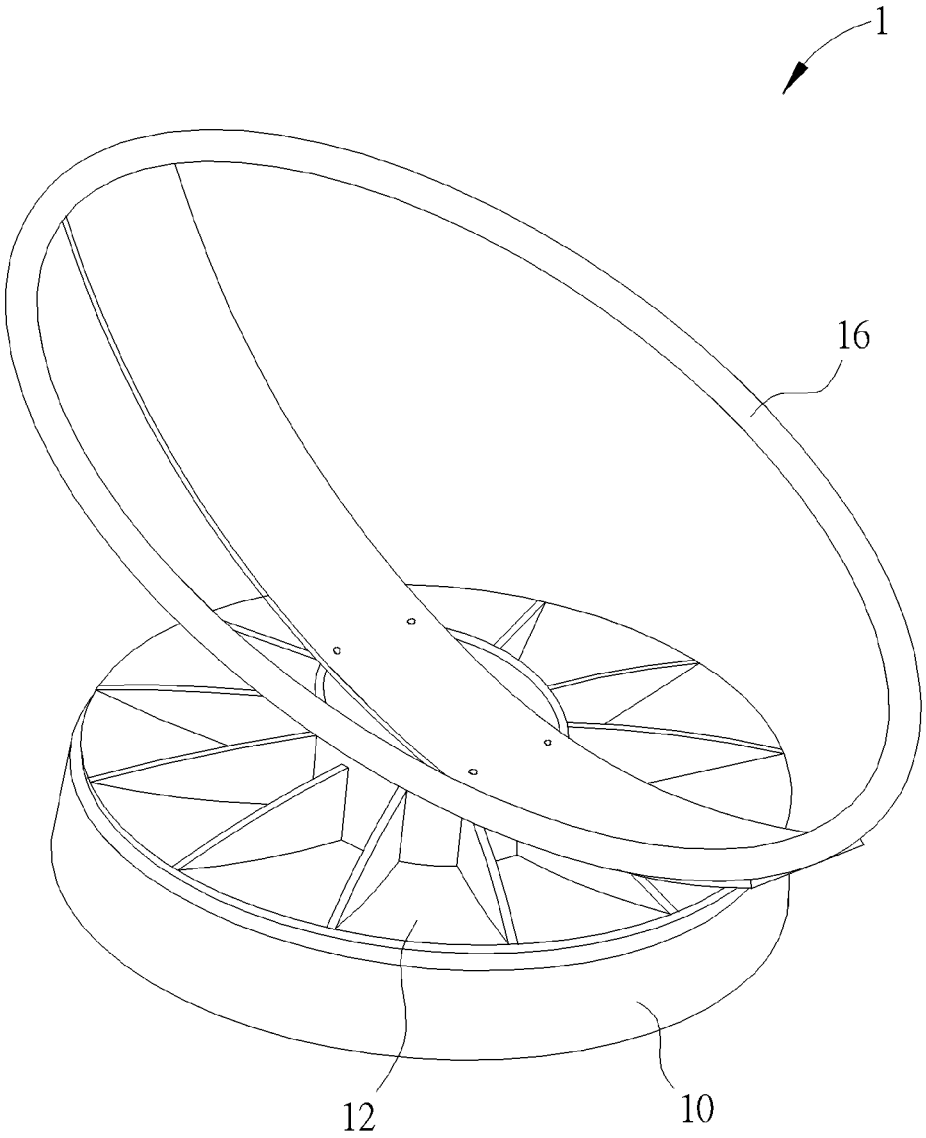
FIG. 1 is a schematic diagram illustrating an infant care apparatus of a preferred embodiment according to the invention.
Figure 2:
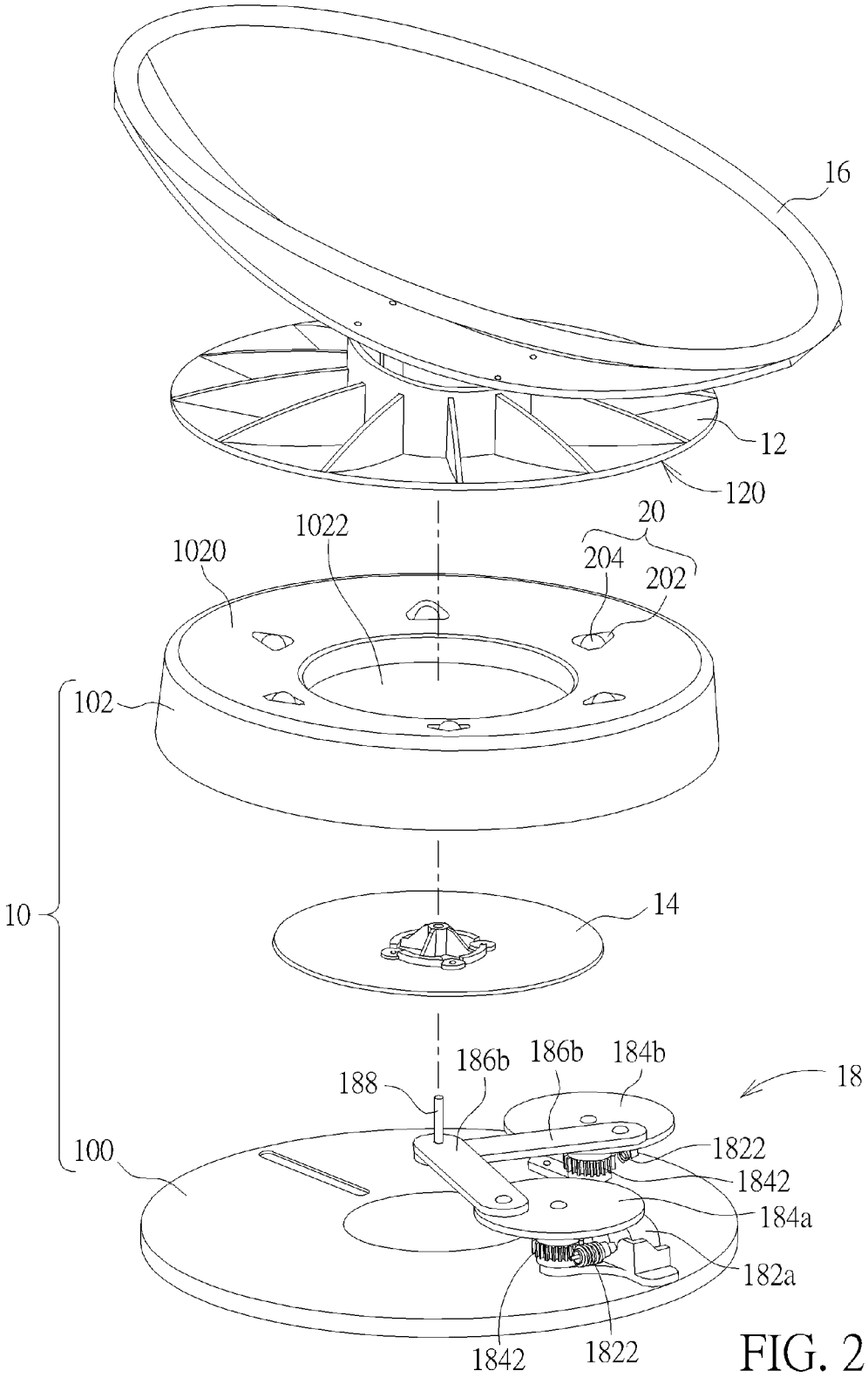
FIG. 2 is an exploded view of the infant care apparatus in FIG. 1.
Figure 3:
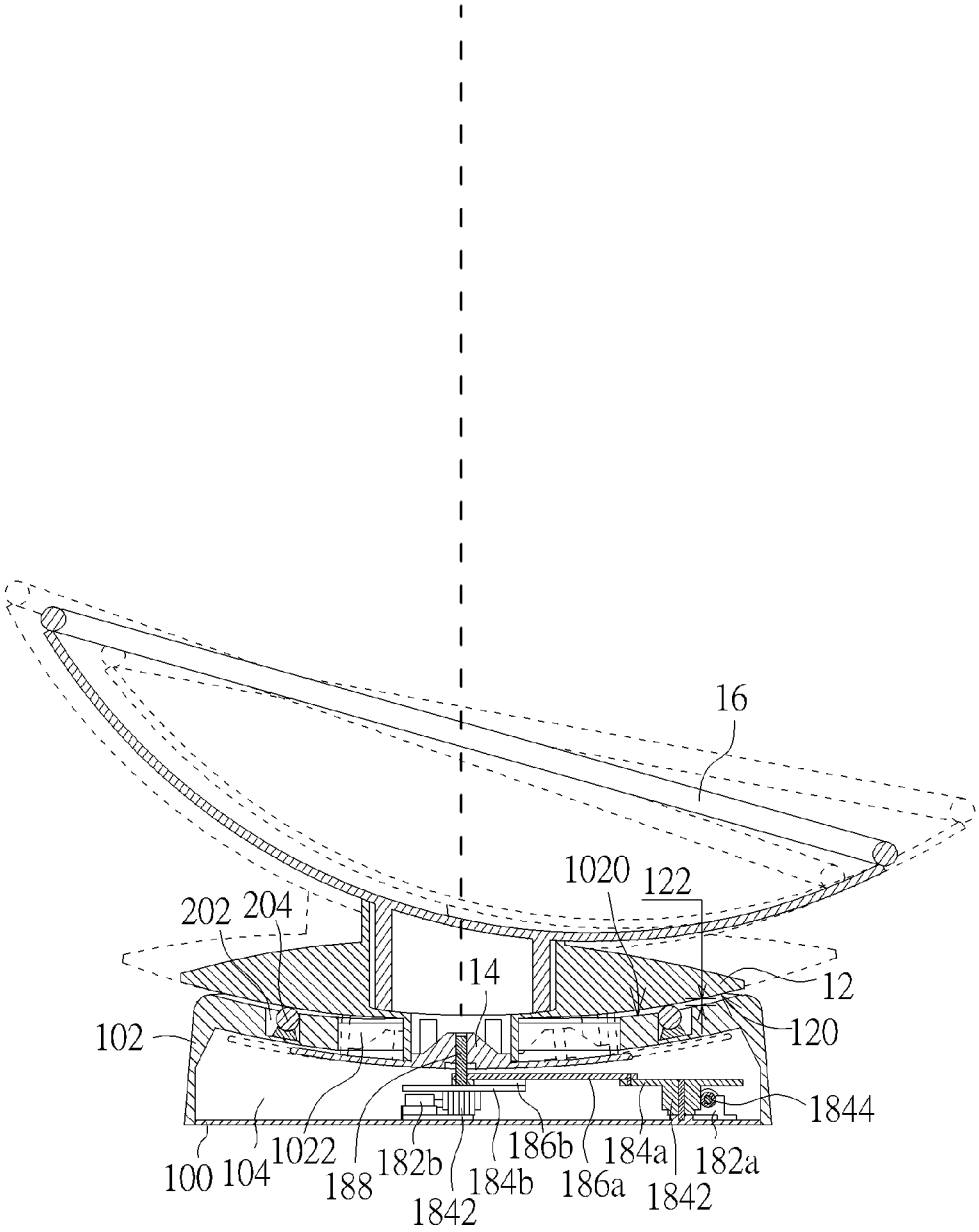
FIG. 3 is a sectional view of the infant care apparatus in FIG. 1.

Please refer to FIGS. 1 through 3. FIG. 1 is a schematic diagram illustrating an infant care apparatus 1 of a preferred embodiment according to the invention. FIG. 2 is an exploded view of the infant care apparatus 1. FIG. 3 is a sectional view of the infant care apparatus 1. The infant care apparatus 1 includes a base 10, a sliding mount 12, a retaining part 14, a seat frame 16, a driving mechanism 18, and a bearing mechanism 20. The base 10 includes a base plate 100 and an upper cover 102 engaged with the base plate 100 for forming an accommodating space 104. The upper cover 102 has a concave surface 1020 and an opening 1022 formed on the concave surface 1020. The sliding mount 12 has a convex surface 120 matching with the concave surface 1020. The sliding mount 12 is disposed above the base 10 such that the convex surface 120 is disposed opposite to the concave surface 1020. The sliding mount 12 is capable of sliding above the concave surface 1020 by the convex surface 120. The seat frame 16 is fixed on the sliding mount 12 to be moved together with the sliding mount 12. In practice, the seat frame 16 thereon will dispose a seat cloth, a carrier or the like for child to sit or lie thereon.

The retaining part 14 is used for preventing the sliding mount 12 from pulling off the base 10, but the invention is not limited thereto. The retaining part 14 is disposed inside the base 10 (i.e. in the accommodating space 104) opposite to the sliding mount 12 relative to the concave surface 1020. The retaining part 14 is connected through the opening 1022 to the sliding mount 12 so that the retaining part 14 slides together with the sliding mount 12, also with the seat frame 16. The profile of the retaining part 14 is larger than the profile of the opening 1022 so that the retaining part 14 can prevent the sliding mount 12 from pulling off the base 10.

In principle, if the friction between the concave surface 1020 and the convex surface 120 is acceptable, the bearing mechanism 20 can be absent in some embodiments. In the embodiment, the bearing mechanism 20 is disposed between the base 10 and the sliding mount 12, so that the sliding mount 12 slides above the concave surface 1020 by the convex surface 120 in a friction-reducing way. Therefore, the convex surface 120 is disposed apart from the concave surface 1020 by a distance 122 (namely a gap), so as to form space for disposing the bearing mechanism 20. In the embodiment, the bearing mechanism 20 includes a plurality of recesses 202 formed on the concave surface 1020 and a plurality of rolling balls 204 disposed in the recesses 202 correspondingly. The sliding mount 12 slides on the rolling balls 204. The rolling balls 204 roll when the sliding mount 12 slides relative to the base 10, which performs the friction-reducing way. In principle, the recesses 202 and the rolling balls 204 are disposed in pairs surrounding the opening 1022 for symmetrically and steadily supporting the sliding mount 12.

In the embodiment the concave surface 1020 is axially symmetrical relative to its central axis, like a bowl shaped surface; the concave surface 120 is also axially symmetrical relative to its central axis, like a saucer shaped surface. Therefore, the seat frame 16 together with the sliding mount 12 can swing relative to the base 10 in two dimensions. As shown by FIG. 3, the seat frame 16 can swing like a pendulum motion without pendulum arm. Therein, the dashed bold line shown in FIG. 3 represents a virtual pendulum arm; the seat frame 16 and the sliding mount 12 sliding to the left and right sides are illustrated by dashed lines. The opening 1022 constrains the connection portion of the sliding mount 12 with the retaining part 14 for preventing the sliding mount 12 glides out of the base 10 and also for keeping the sliding mount 12 smoothly and steadily gliding on the rolling balls 204. The movement trajectory of the sliding mount 12 in FIG. 3 occurs on a plane, but the invention is not limited thereto. In practice, the sliding mount 12 can swing at a 3-dimension trajectory.

Figure 4:
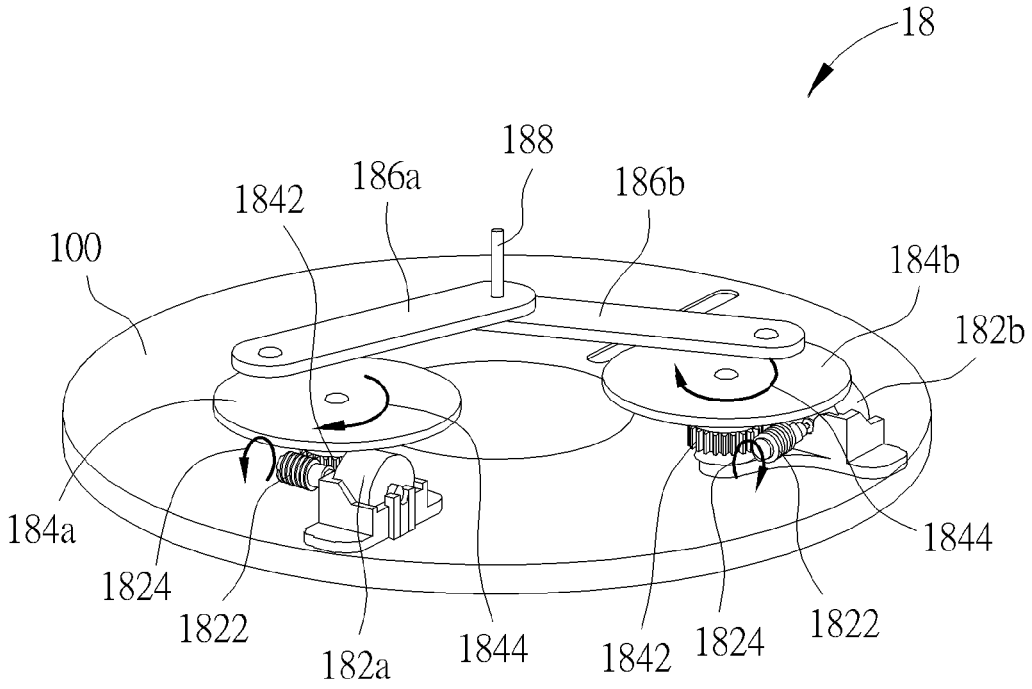
FIG. 4 is a schematic diagram illustrating a driving mechanism of the infant care apparatus in FIG. 1.

Please also refer to FIG. 4, which is a schematic diagram illustrating the driving mechanism 18. In the embodiment, the driving mechanism 18 is disposed in the accommodating space 104 for driving the retaining part 14 to move, i.e. for driving the sliding mount 12 to slide above the concave surface 1020. The driving mechanism 18 includes two driving motors 182*a* and 182*b*, two driven wheels 184*a* and 184*b*, two link arms 186*a* and 186*b*, and a connection part 188. The two driven wheels 184*a* and 184*b* are pivotally connected to the base plate 100. The two driving motors 182*a* and 182*b* are dynamically linked to the two driven wheels 184*a* and 184*b* respectively. In the embodiment, the driving motors 182*a* and 182*b* are linked to the wheels 184*a* and 184*b* by a worm gear 1822 meshing with a spur gear 1842, but the invention is not limited thereto. The two link arms 186*a* and 186*b* are pivotally and eccentrically connected to the two driven wheels 184*a* and 184*b* respectively and pivotally connected to each other. Therefore, the base plate 100, the driven wheels 184*a* and 184*b*, and the two link arms 186*a* and 186*b* form a five-bar linkage having two degrees of freedom. The connection part 188 is disposed on one of the two link arms 186*a* and 186*b* so that the movement trajectory of the connection part 188 can be determined by the five-bar linkage. In the embodiment, the connection part 188 is disposed such as by pin-joining where the two link arms 186*a* and 186*b* are connected, but the invention is not limited thereto. In principle, it is sufficient for determining the movement of the connection part 188 to dispose the connection part 188 on any link of the five-bar linkage excluding the base plate 100. The connection part 188 is also connected to the sliding mount 12, so that the sliding mount 12 and the seat frame 16 move following the connection part 188. In the embodiment, the connection part 188 is inserted into a hole formed on the bottom of the sliding mount 12, but the invention is not limited thereto. It is added that the connection part 188 moves on a virtual plane while the sliding mount 12 moves parallel to a curved surface (e.g. the concave surface 1020), so in practice, the hole may be a little larger than the connection part 188 for avoiding structural interference therebetween. Such structural interference also can be alternatively solved by using a ball joint between the connection part 188 and the sliding mount 12 or between the connection part 188 and the link arms 186*a* and 186*b*.

Figure 5:
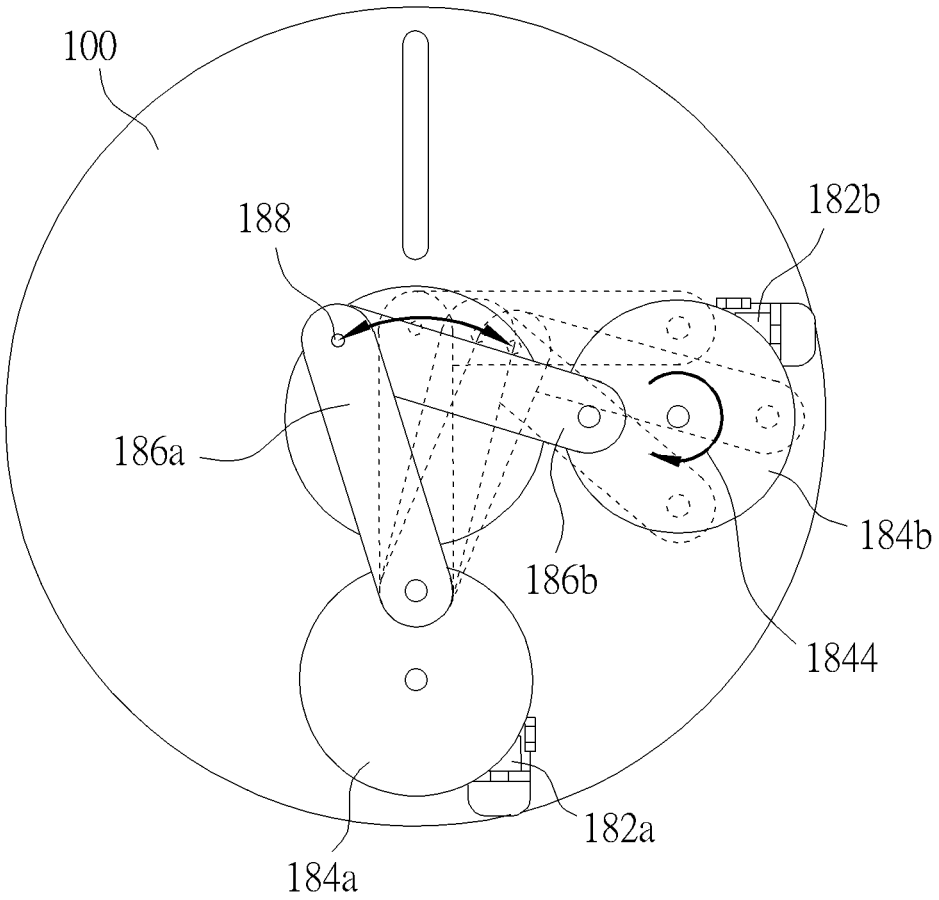
FIG. 5 is a schematic diagram illustrating the movement of the driving mechanism in a top view thereof according an embodiment.
Figure 6:
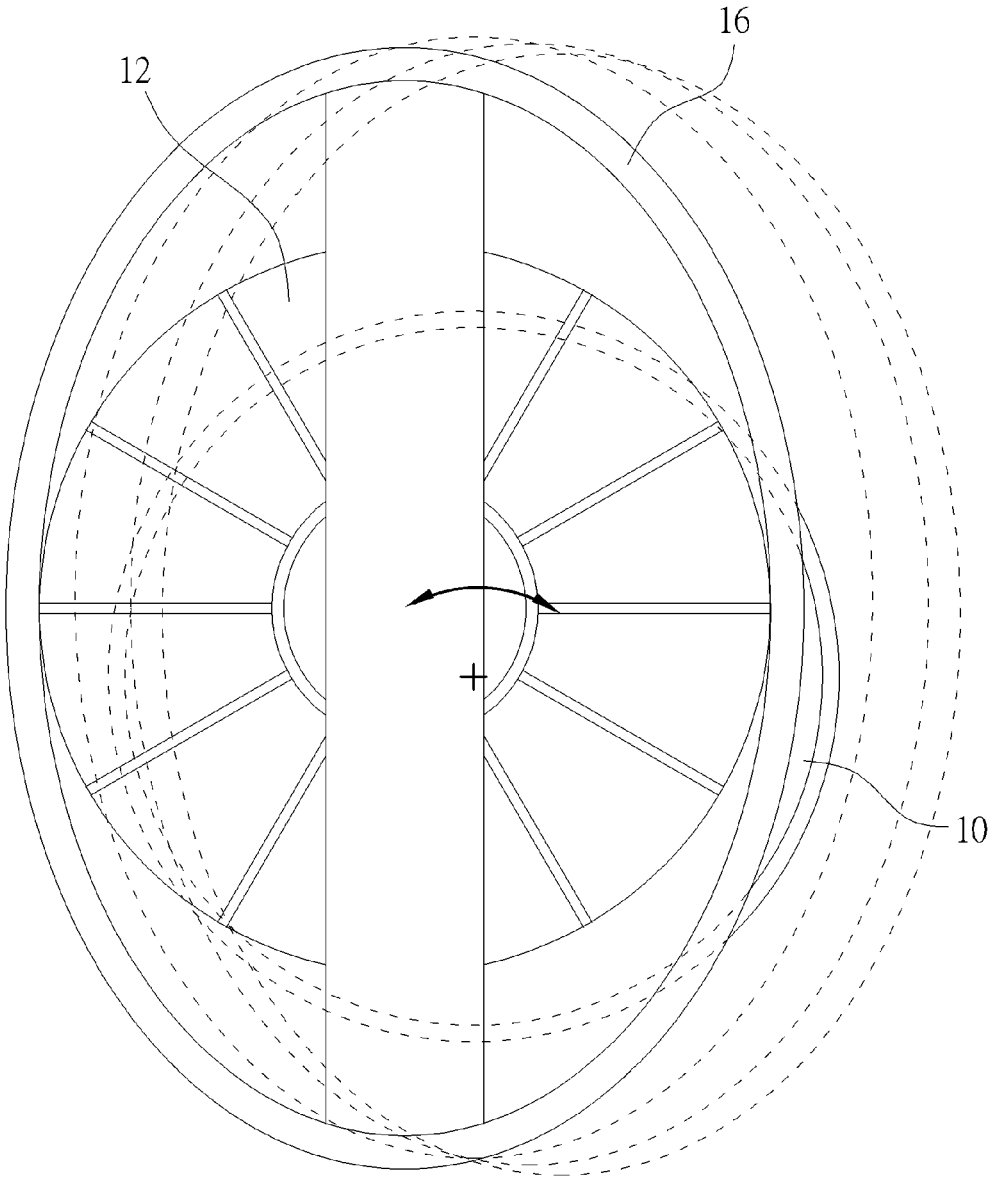
FIG. 6, which is a schematic diagram illustrating the movement of the sliding mount together with the seat frame in accordance with the action of the driving mechanism in FIG. 5.

In practice, the five-bar linkage will be driven by the two driving motors 182*a* and 182*b* through the two driven wheels 184*a* and 184*b*. In other words, each of the driving motors 182*a* and 182*b* has a rotation direction 1824 (indicated by an arrow in FIG. 4) and a rotation speed. Each worm gear 1822 pressed on a shaft of the corresponding motor 182*a* or 182*b* can be individually controlled to rotate by setting the rotation direction 1824 and the rotation speed of the corresponding motor 182*a* or 182*b*, so as to rotate the corresponding driven wheel 184*a* or 184*b* through the corresponding spur gear 1842. Therein, the direction of the arrow in FIG. 4 is just used for reference and not for confining the practical rotation direction of the worm gear 1822 (or the shaft of the corresponding motor 182*a* or 182*b*); in practice, for rotating in a reverse direction to the rotation direction 1824 illustrated in FIG. 4, the driving motor 182*a* or 182*b* can be set to rotate in a negative rotation speed. The driven wheels 184*a* and 184*b* are then driven to rotate in a rotation direction 1844 which is determined by the rotation directions 1824 of the driving motors 182*a* and 182*b* correspondingly. Therefore, the operation of the driving motors 182*a* and 182*b* will determine the movement trajectory of the connection part 188 and also the sliding mount 12 and the seat frame 16. The control of the driving motors 182*a* and 182*b* can be performed through a control module which provides a manipulation interface (such as a touch panel disposed on the base 10) for parents to set parameters (including at least the rotation directions 1824 and the rotation speeds of the driving motors 182*a* and 182*b*) for the movement trajectory of the seat frame 16 (or the connection part 188 precisely). Please refer to FIG. 4 and FIG. 5. FIG. 5 is a schematic diagram illustrating the movement of the driving mechanism 18 in a top view thereof according an embodiment. The two motors 182*a* and 182*b* are controlled individually to drive the two wheels 184*a* and 184*b* so as to move the connection part 188 in a specific motion path. In this embodiment, the driving motor 182*a* is halted (e.g. the corresponding rotation speed is set to be zero), so the driven wheel 184*a* is immobile. The five-bar linkage acts like a four-bar linkage now. When the driving motor 182*b* rotates in the rotation direction 1824, the driven wheel 184*b* is driven to rotate in the rotation direction 1844 to link the link arms 186*a* and 186*b* to move back and forth in an almost horizontal (or left-to-right) motion path. The motion path is shown by an arc with arrows in FIG. 5. The movement speed of the connection part 188 is also determined by the setting for the rotation direction 1824 and the rotation speed of the driving motor 182*b*. Therefore, the specific motion path for this embodiment is a left-to-right (or front-to-back) motion path. Please refer to FIG. 6, which is a schematic diagram illustrating the movement of the sliding mount 12 together with the seat frame 16 in accordance with the action of the driving mechanism 18 in FIG. 5; therein, the arc with arrows also represents the movement trajectory of the seat frame 16. The cross mark represents the center of the base 10 for reference. The sliding mount 12 together with the seat frame 16 will be moved left and right in a horizontal direction due to the connection part 188 (as shown by FIG. 6) and up and down in a vertical direction due to the concave surface 1020 (referring to FIG. 3).

Figure 7:
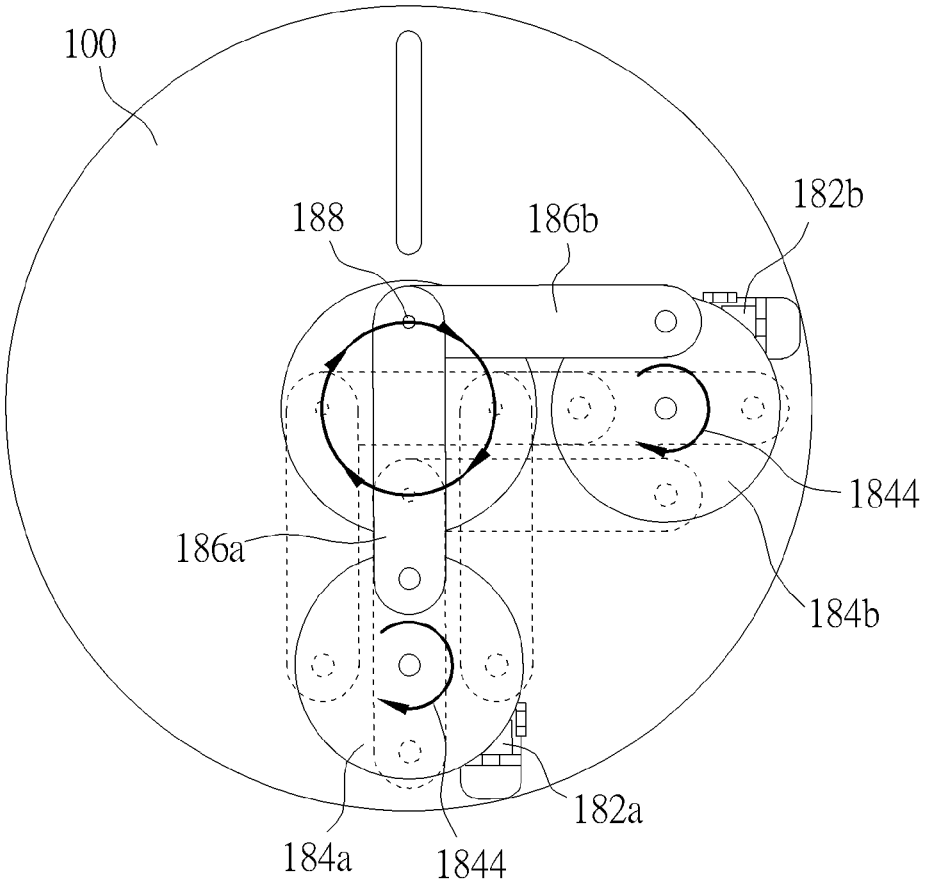
FIG. 7 is a schematic diagram illustrating the movement of the driving mechanism in a top view thereof according another embodiment.
Figure 8:
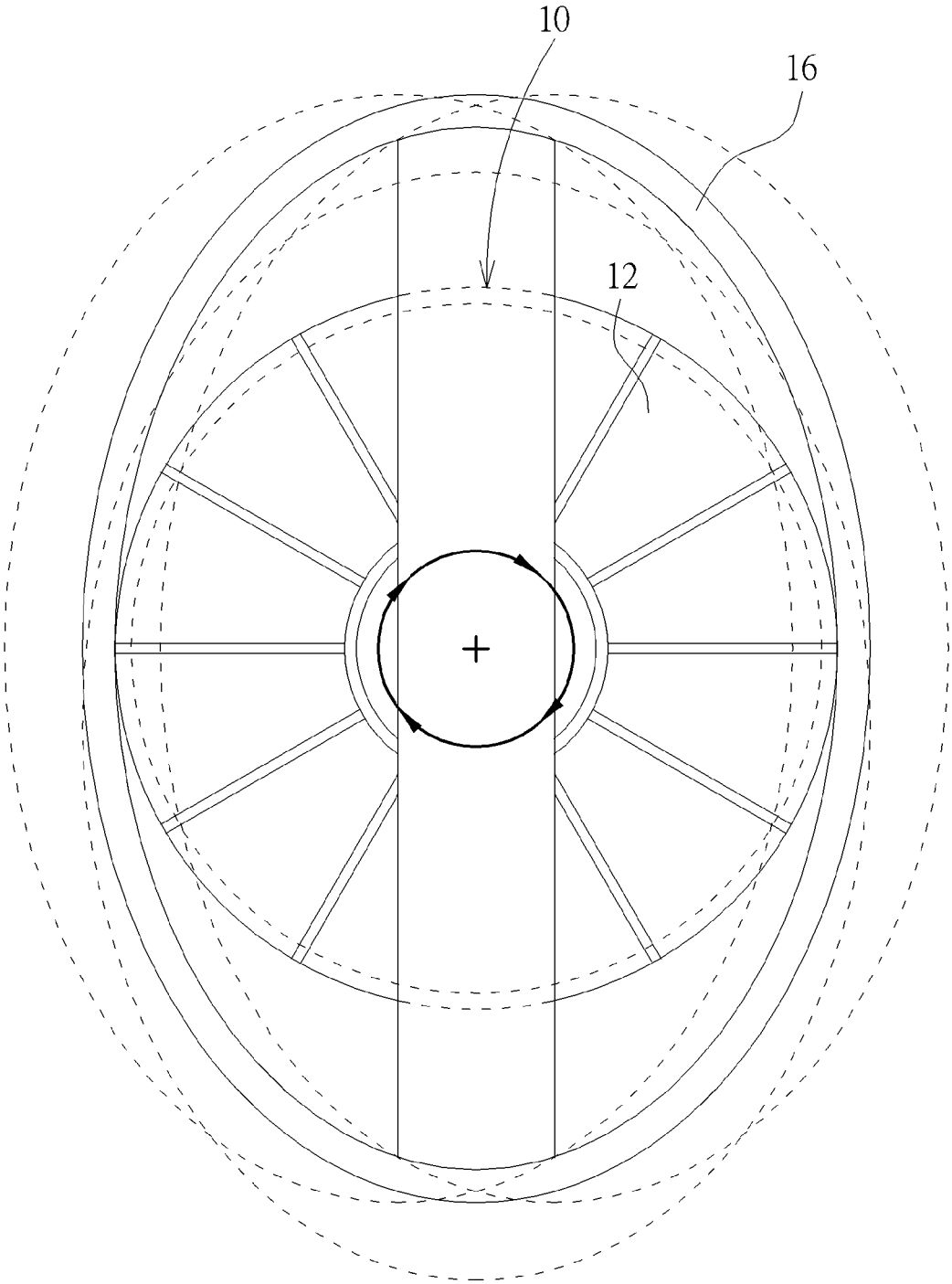
FIG. 8 is a schematic diagram illustrating the movement of the sliding mount together with the seat frame in accordance with the action of the driving mechanism in FIG. 7.

Please refer to FIG. 7 and FIG. 8. FIG. 7 is a schematic diagram illustrating the movement of the driving mechanism 18 in a top view thereof according another embodiment. FIG. 8 is a schematic diagram illustrating the movement of the sliding mount 12 together with the seat frame 16 in accordance with the action of the driving mechanism in FIG. 7;

therein, the circle with arrows also represents the movement trajectory of the seat frame 16. The cross mark represents the center of the base 10 for reference. In this embodiment, the driving motors 182*a* and 182*b* rotate synchronously in the rotation direction 1824, so the driven wheels 184*a* and 184*b* are driven to also rotate synchronously in the rotation direction 1844 so that the link arms 186*a* and 186*b* are moved as a whole and the connection part 188 moves in a circular motion path shown by a circle with arrows in FIG. 7. The movement speed of the connection part 188 is also determined by the setting for the rotation directions 1824 and the rotation speeds of the driving motors 182*a* and 182*b*. In this embodiment, the circular motion path is symmetrical to the centric axis of the concave surface 1020, so the sliding mount 12 together with the seat frame 16 will be moved horizontally.

It is added that, the length and location of the motion path can be modified by setting the link lengths and the initial state (including positions and velocities) of the five-bar linkage even for the same kind motion path such as the foregoing front-to-back motion path and circular motion path. In the embodiment, the specific motion path is programmable by controlling the rotation conditions (including rotation speed and relative phase) of the driving motors 182*a* and 182*b*. In practice, the specific motion path can be but not limited to one of the following of a front-to-back motion path, a figure-8 motion path, a circular motion path, a combined motion path of at least two of the above motion paths, and even a random motion path which all can operate within the range of area that is always pre-determined by the lengths of the links and the rotation speed of the driving motors 182*a* and 182*b*.

Figure 9:
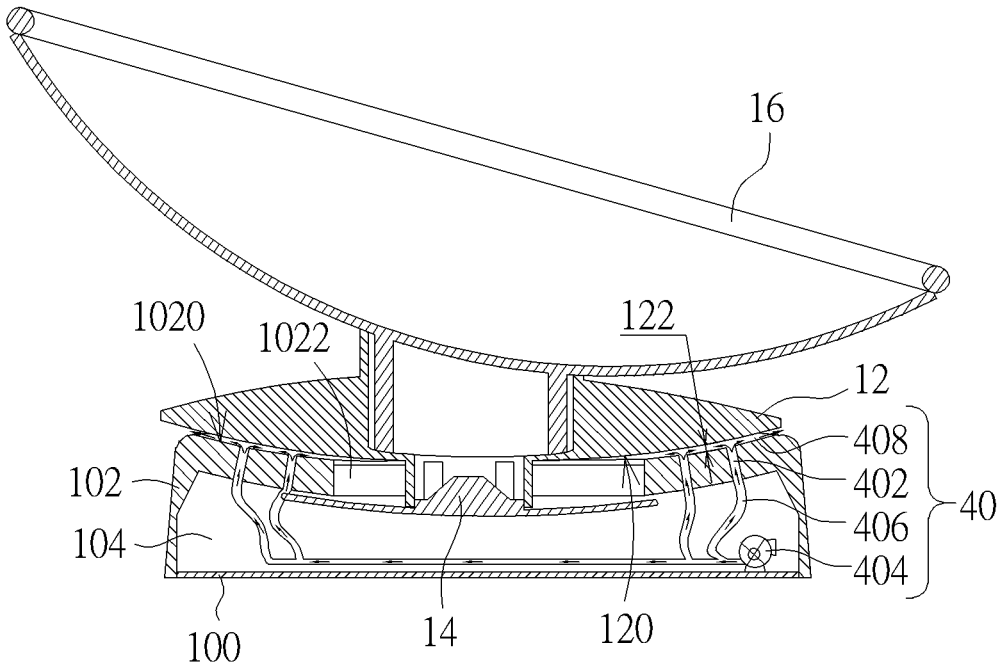
FIG. 9 is a sectional view of an infant care apparatus of another embodiment according to the invention.

In the above embodiments, the bearing mechanism 20 is performed by rolling bearing, but the invention is not limited thereto. Please refer to FIG. 9, which is a sectional view of an infant care apparatus 3 of another embodiment according to the invention. The infant care apparatus 3 is similar to the infant care apparatus 1 excluding the bearing mechanism 20. A bearing mechanism 40 of the infant care apparatus 3 is a kind of fluid bearing. The bearing mechanism 40 a plurality of fluid outlets 402 formed through the concave surface 1020 and a fluid pressurization device 404 disposed in the accommodating space 104. In practice, the fluid outlets are connected to the fluid pressurization device 404 by tubes 406. The fluid pressurization device 404 can pressurize a fluid through the fluid outlets 402 to form a fluid film 408 between the concave surface 1020 and the convex surface 120. The flowing direction of the fluid is represented by arrows in FIG. 9. The fluid film 408 needs to have enough pressure to sustain (or lift) the weight of the sliding mount 12 (also the seat frame 16 and the child sitting thereon) so that the sliding mount 12 can float on the fluid film 408 smoothly, which can be ensured by the fluid pressurization device 404 and can be easily accomplished by a skilled person in the art. In the embodiment, the fluid is air, and the fluid pressurization device 404 is an air compressor; however, the invention is not limited thereto. It is added that, if a fluid of high viscosity which can provide a higher film tension is used, the fluid film produced by such fluid also can directly act as the bearing mechanism of the invention, and accordingly, the fluid pressurization device is unwanted.

In the above embodiments, the seat frame 16 is driven by the driving mechanism 18 to move, but the invention is not limited thereto. In practice, with an absence of the driving mechanism 18, the sliding mount 12 (and the seat frame 16) still can be moved by man power. For example, the parents can first slide the seat frame 16 upward so that the seat frame 16 gets a potential energy and then leave the seat frame 16 to glide above the concave surface 1020. When the friction force between the sliding mount 12 and the base 10 is less or can be neglected, the above gliding will continue for a certain long time. It also can perform a soothing effect.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant care apparatus, comprising:

a base, having a concave surface;

a sliding mount, having a convex surface matching with the concave surface and disposed opposite to the concave surface, the convex surface being disposed apart from the concave surface by a distance, the sliding mount sliding above the concave surface by the convex surface;

a seat frame, fixed on the sliding mount to be moved together with the sliding mount; and a bearing mechanism, disposed between the base and the sliding mount, so that the sliding mount slides above the concave surface by the convex surface in a friction-reducing way, the bearing mechanism comprising a plurality of fluid outlets formed through the concave surface and a fluid pressurization device for pressurizing a fluid through the fluid outlets to form a fluid film between the concave surface and the convex surface, the sliding mount floating on the fluid film.

2. The infant care apparatus of claim 1, wherein the bearing mechanism comprises a plurality of recesses formed on the concave surface and a plurality of rolling balls disposed in the recesses correspondingly, and the sliding mount slides on the rolling balls.

3. The infant care apparatus of claim 1, further comprising a retaining part disposed inside the base opposite to the sliding mount relative to the concave surface, the base having an opening formed on the concave surface, a profile of the retaining part being larger than the profile of the opening, the retaining part being connected through the opening to the sliding mount so that the retaining part slides together with the sliding mount.

4. The infant care apparatus of claim 1, further comprising a driving mechanism connected to the sliding mount for driving the sliding mount to slide above the concave surface.

5. The infant care apparatus of claim 4, wherein the driving mechanism comprises two driving motors, two driven wheels, two link arms, and a connection part, the two driven wheels are pivotally connected to the base, the two driving motors are dynamically linked to the two driven wheels respectively, the two link arms are pivotally and eccentrically connected to the two driven wheels respectively and pivotally connected to each other, and the connection part is disposed on the two link arms and connected to the sliding mount for moving the sliding mount.

6. The infant care apparatus of claim 5, wherein the two motors are controlled individually to drive the two wheels so as to move the connection part in a specific motion path.

7. The infant care apparatus of claim 6, wherein each motor has a rotation direction and a rotation speed, each motor is controlled by setting the rotation direction and the rotation speed so as to drive the corresponding wheel to rotate.

8. The infant care apparatus of claim 6, wherein the specific motion path is a front-to-back motion path, a figure-8 motion path, a circular motion path, or a combined motion path of at least two of the above motion paths.

9. An infant care apparatus, comprising:

a base, having a concave surface;

a sliding mount, having a convex surface matching with the concave surface and disposed opposite to the concave surface, the sliding mount sliding above the concave surface by the convex surface;

a seat frame, fixed on the sliding mount to be moved together with the sliding mount; and a driving mechanism, connected to the sliding mount, for driving the sliding mount to slide above the concave surface, the driving mechanism comprising two driving motors, two driven wheels, two link arms, and a connection part, the two driven wheels being pivotally connected to the base, the two driving motors being dynamically linked to the two driven wheels respectively, the two link arms being pivotally and eccentrically connected to the two driven wheels respectively and pivotally connected to each other, the connection part being disposed on the two link arms and connected to the sliding mount for moving the sliding mount.

10. The infant care apparatus of claim 9, wherein the convex surface is disposed apart from the concave surface by a distance.

11. The infant care apparatus of claim 10, further comprising a bearing mechanism disposed between the base and the sliding mount, so that the sliding mount slides above the concave surface by the convex surface in a friction-reducing way.

12. The infant care apparatus of claim 11, wherein the bearing mechanism comprises a plurality of recesses formed on the concave surface and a plurality of rolling balls disposed in the recesses correspondingly, and the sliding mount slides on the rolling balls.

13. The infant care apparatus of claim 11, wherein the bearing mechanism comprises a plurality of fluid outlets formed through the concave surface and a fluid pressurization device for pressurizing a fluid through the fluid outlets to form a fluid film between the concave surface and the convex surface, and the sliding mount floats on the fluid film.

14. The infant care apparatus of claim 9, further comprising a retaining part disposed inside the base opposite to the sliding mount relative to the concave surface, the base having an opening formed on the concave surface, a profile of the retaining part being larger than the profile of the opening, the retaining part being connected through the opening to the sliding mount so that the retaining part slides together with the sliding mount.

15. The infant care apparatus of claim 9, wherein the two motors are controlled individually to drive the two wheels so as to move the connection part in a specific motion path.

16. The infant care apparatus of claim 15, wherein each motor has a rotation direction and a rotation speed, each motor is controlled by setting the rotation direction and the rotation speed so as to drive the corresponding wheel to rotate.

17. The infant care apparatus of claim 15, wherein the specific motion path is a front-to-back motion path, a figure-8 motion path, a circular motion path, or a combined motion path of at least two of the above motion paths.

* * * * *